US011365356B2

(12) United States Patent
Wu et al.

(10) Patent No.: US 11,365,356 B2
(45) Date of Patent: Jun. 21, 2022

(54) PROCESS AND PROCESS LINE FOR SOLVENT EXTRACTION OF BITUMEN FROM OIL SANDS

(71) Applicant: SYNCRUDE CANADA LTD. in trust for the owners of the Syncrude Project as such owners exist now and in the future, Calgary (CA)

(72) Inventors: Xin Alex Wu, Edmonton (CA); Michael Carniato, Sherwood Park (CA)

(73) Assignee: SYNCRUDE CANADA LTD., Calgary (CA), in trust for the owners of the Syncrude Project as such owners exist now and in the future ( * ) Notice: Subject to any disclaimer, the term of this patent is extended or adjusted under 35 U.S.C. 154(b) by 0 days.

(21) Appl. No.: 17/021,494

(22) Filed: Sep. 15, 2020

(65) Prior Publication Data

US 2021/0079303 A1 Mar. 18, 2021

Related U.S. Application Data

(60) Provisional application No. 62/901,059, filed on Sep. 16, 2019.

(51) Int. Cl.
*C10G 1/04* (2006.01)

(52) U.S. Cl.
CPC ..... *C10G 1/045* (2013.01); *C10G 1/04* (2013.01)

(58) Field of Classification Search
CPC ..... C10G 1/04–045
See application file for complete search history.

(56) References Cited

U.S. PATENT DOCUMENTS

| | | | | |
|---|---|---|---|---|
| 7,431,830 | B2 * | 10/2008 | Cleminson | C10L 1/326 196/14.52 |
| 2011/0180459 | A1 * | 7/2011 | Duyvesteyn | C10G 1/042 208/391 |
| 2014/0216985 | A1 * | 8/2014 | Blackbourn | C10G 1/04 208/390 |
| 2014/0231312 | A1 * | 8/2014 | Colenbrander | C10G 1/045 208/390 |
| 2016/0362608 | A1 * | 12/2016 | Wu | C10G 1/047 |

FOREIGN PATENT DOCUMENTS

| | | |
|---|---|---|
| CA | 2715301 A1 | 3/2011 |
| CA | 2724806 C | 6/2011 |
| CA | 2714236 A1 | 3/2012 |

(Continued)

*Primary Examiner* — Renee Robinson
(74) *Attorney, Agent, or Firm* — Bennett Jones LLP; Irene T. Bridger

(57) ABSTRACT

A process for forming a deaerated oil sand slurry is provided comprising: providing a first vessel having an overhead space and a bottom space; delivering oil sand and a low vapor pressure hydrocarbon liquid into the overhead space and mixing the oil sand and hydrocarbon liquid to release air trapped in the oil sand and form the deaerated slurry; optionally adding an inert gas stream to the overhead space to displace the air released from the oil sand; and collecting the deaerated slurry in the bottom space to form a slurry layer to prevent gas exchange between the first vessel and downstream extraction equipment.

47 Claims, 3 Drawing Sheets

(56) References Cited

FOREIGN PATENT DOCUMENTS

| | | | |
|---|---|---|---|
| CA | 2751719 | A1 | 3/2012 |
| CA | 2740670 | A1 | 11/2012 |
| CA | 2794373 | A1 | 5/2014 |
| CA | 2842968 | A1 | 8/2014 |
| CA | 2895118 | C | 12/2016 |

* cited by examiner

PROCESS AND PROCESS LINE FOR SOLVENT EXTRACTION OF BITUMEN FROM OIL SANDS

FIELD OF THE INVENTION

The present invention relates generally to solvent extraction of bitumen from mined oil sands. In particular, a process and process line is provided for producing an oil sand slurry with a low vapor pressure hydrocarbon liquid for further bitumen extraction.

BACKGROUND OF THE INVENTION

The present commercial bitumen extraction process for mined oil sands is Clark hot water extraction technology or its variants that use large amounts of water and generate a great quantity of wet tailings. Part of the wet tailings becomes fluid fine tailings (FFT), which contain approximately 30% fine solids and are a great challenge for the industry to reclaim. In addition, certain "problem" oil sands, often having high fines content, yield low bitumen recoveries in the water-based extraction process. This leads to economic losses and environmental issues with bitumen in wet tailings.

An alternative to water-based extraction is solvent extraction of bitumen from mined oil sands, which uses little or no water, generates no wet tailings, and can potentially achieve higher bitumen recovery than the existing water-based extraction, especially for the aforementioned problem oil sands. Therefore, solvent extraction is potentially more robust and more environmentally friendly than water-based extraction.

One key challenge of solvent extraction processes is that mined oil sand, which contains air pockets, is not suitable for direct mixing with flammable solvents. Because of the presence of these air pockets, the oil sand feed needs to be deaerated and rendered inert (hereinafter referred to as "inerting"), while keeping minimal loss of volatile solvents. Another challenge is the ability to transport oil sands from the mine to the extraction plant economically. In water-based extraction, water is used as a carrier fluid to hydrotransport oil sand slurry to an extraction plant. However, in solvent extraction, if a light flammable solvent is sent to the mine for slurry preparation, the oil sand inerting step has to be carried out in the mine which has less infrastructure than an extraction plant. Furthermore, any leak or spill of the flammable slurry along the long-distance pipeline creates a severe fire hazard.

In Canadian Patent No. 2,724,806, a gas blanket was proposed to replace air in the oil sand prior to addition of a solvent. The gas includes nitrogen, methane, carbon dioxide, argon, steam, or a combination of thereof. However, no detail was given regarding the method and apparatus to connect the inerting equipment to the downstream equipment containing solvent vapor. This apparatus must allow unobstructed flow of oil sands downstream without the backflow of solvent vapor upstream.

Attempts to solve the above issues by using two solvents sequentially encounter solid/liquid separation problems and issues with higher solvent demand and operating costs. A non-volatile light gas oil and bitumen mixture for initial slurry preparation is disclosed in Canadian Patent No. 2,751,719. Inert gas blanketing is provided in the contact vessel in case light hydrocarbon contaminant is present in the mixture. Minimizing contaminant through proper operation of a distillation unit may decrease solvent vapor release in semisealed slurry conditioning units. However, this process requires a second light volatile solvent to facilitate solvent-diluted bitumen separation and solvent recovery from solids.

In Canadian Patent Application No. 2,715,301 and Canadian Patent Application No. 2,842,968, oil sands pass through a hopper-like vessel with nitrogen purge and the oil sand layer in the vessel forms a barrier between the overhead space of the vessel containing nitrogen/air and the vapor space of the downstream extractor containing flammable solvent vapor. In Canadian Patent Application No. 2,715,301, a more elaborate two-stage apparatus including hoppers/surge chambers and solids feeders such as Posimetric feeders at the bottom of each hopper was proposed. However, none of the hoppers or solids feeders are actual airlocks. Significant exchange of nitrogen/air upstream and solvent vapor downstream would occur. Excessive purge with nitrogen to remove oxygen in entrained air inevitably leads to high solvent loss in vented gas.

In Canadian Patent No. 2,751,719 and Canadian Patent No. 2,895,118, a heavy solvent, which is composed of non-flammable light gas oil, is used to make dense slurry with oil sand first to aid the deaeration and inerting process. The equipment to make dense slurry may be pre-purged with nitrogen to have a reduced oxygen environment. A light flammable solvent is introduced to a downstream vessel which is further purged with nitrogen to have lower oxygen concentration in its vapor space for safety. The downstream vessel is connected with the upstream vessel through an airlock such as a rotary valve. Rotary valves work more reliably with dense slurry than with raw oil sands which would cause plugging and jamming issues. However, the upstream equipment for dense slurry preparation, e.g. a tumbler, described in these patents contains large vapor space making it difficult to pre-purge to achieve reduced oxygen environment. Furthermore, mere airlock isolation is unlikely to be adequate to prevent the escape of light solvent vapor and ingress of nitrogen/air to the downstream vessel. In summary, a better apparatus is required to effectively separate out the upstream and downstream vapor spaces without gas exchange.

Regarding long-distance transport of oil sands from a mine to an extraction plant, Canadian Patent Application No. 2,714,236 and Canadian Patent No. 2,740,670 taught pipelining oil sand slurry containing light flammable solvents. As mentioned above, inadequate explosion-proof and fire-fighting infrastructure in the mine and fire hazard along the pipeline are the potential issues. A safer method of pipelining solvent-based oil sand slurry is needed.

SUMMARY OF THE INVENTION

The present invention relates generally to solvent extraction of bitumen from mined oil sands. In particular, a process and process line is provided for producing an oil sand slurry with a low vapor pressure hydrocarbon liquid for further bitumen extraction.

In one aspect, a process is provided for forming a deaerated oil sand slurry, comprising:

- providing a vessel having an overhead space and a bottom space;
- delivering oil sand and a low vapor pressure hydrocarbon liquid into the overhead space and mixing the oil sand and hydrocarbon liquid to release air trapped in the oil sand and form the deaerated slurry;
- optionally adding an inert gas stream to the overhead space to displace the air released from the oil sand; and collecting the deaerated slurry in the bottom space to form a slurry layer to prevent gas exchange between the vessel and downstream extraction equipment.

In one embodiment, the low vapor pressure hydrocarbon liquid comprises a heavy solvent (HS) and bitumen. In one embodiment, the low vapor pressure hydrocarbon liquid is a mixture of heavy solvent (HS), light solvent (LS) and bitumen. In one embodiment, the low vapor pressure hydrocarbon liquid is a mixture of light solvent (LS) and bitumen. In one embodiment, the oil sand is pre-crushed oil sand.

BRIEF DESCRIPTION OF THE DRAWINGS

The invention will now be described by way of an exemplary embodiment with reference to the accompanying simplified, diagrammatic, not-to-scale drawings.

DETAILED DESCRIPTION OF PREFERRED EMBODIMENTS

Figure 1:
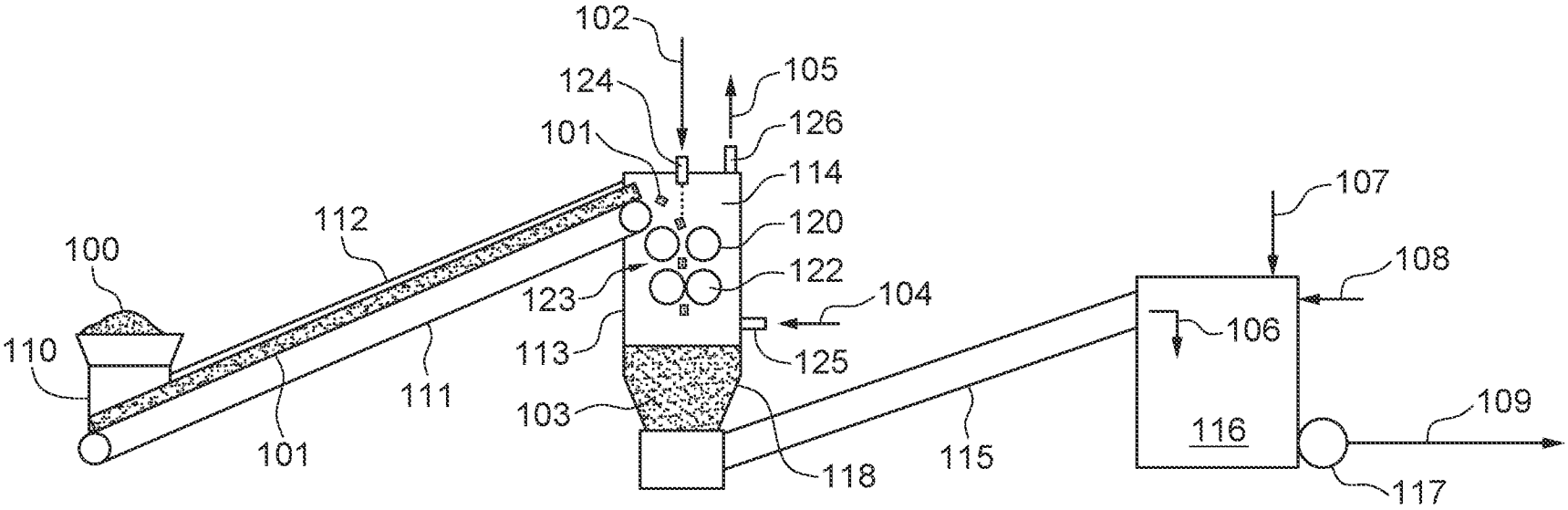
FIG. 1 is a schematic diagram of one embodiment of the present solvent extraction process.

The detailed description set forth below in connection with the appended drawings is intended as a description of various embodiments of the present invention and is not intended to represent the only embodiments contemplated by the inventors. The detailed description includes specific details for the purpose of providing a comprehensive understanding of the present invention. However, it will be apparent to those skilled in the art that the present invention may be practised without these specific details.

The present invention relates generally to a solvent extraction process and, more particularly, a process and process line for producing an oil sand slurry with a solvent for bitumen extraction.

As previously mentioned, one key challenge of solvent extraction processes for extracting bitumen from oil sands is that oil sands contain air pockets, which make the oil sands unsuitable for direct mixing with flammable solvents. Thus, it is necessary to deaerate and inert the oil sand feed while keeping minimal loss of volatile solvents.

As used herein, "heavy solvent (HS)" means a light gas oil stream, for example, a distillation fraction of oil sand bitumen, comprising a mixture of $C_9$ to $C_{32}$ hydrocarbons with a boiling range within about 130° C. to about 470° C. The light end boiling below about 170° C. should be less than 5 wt %. It has a flash point of about 90° C. in air.

As used herein, "light solvent (LS)" means a hydrocarbon stream comprising $C_6$-$C_{10}$ hydrocarbons with a boiling range of 60-170° C. The preferred LS is aliphatic $C_6$-$C_7$ with a boiling range of 69-110° C. It has a flash point below 0° C. in air.

As used herein, "bitumen-lean" means less than 35 wt % bitumen, "bitumen-rich" means 35-50 wt % bitumen, and "highly bitumen-rich" means greater than 50 wt % bitumen.

As used herein, "low vapor pressure hydrocarbon liquid" means either inherently low vapor pressure liquid such as bitumen and HS mixture or practically low vapor pressure liquid such as bitumen and LS mixture. In the latter case, the hydrocarbon liquid after in contact with oil sand becomes a "highly bitumen-rich" solution below 20° C. The high bitumen concentration and low temperature suppress the vapor pressure of LS sufficiently that loss of volatile LS becomes minimal in the presence of a purging gas.

As used herein, "virgin light gas oil" is a front-end cut from bitumen with a boiling range of about 130° C. to about 470° C. As used herein, "light naphtha" is a hydrocarbon solvent comprising mainly aliphatic $C_6$-$C_9$ hydrocarbons with a boiling range of about 60° C. to about 160° C. As used herein, "solvent-rich hydrocarbon liquids" are liquids having a bitumen concentration of about 4 wt % to about 12 wt %, e.g., HS+LS or LS alone solutions with bitumen concentrations of 4-12 wt %.

As used herein "loose oil sand" means oil sand having a density lower than 1600 kg/m3. As used herein, "compact oil sand" means oil sand having a density higher than 1600 kg/m3.

As used herein, "long distance" means a distance longer than 100 m. As used herein, "short distance" means a distance shorter that 100 m.

As used herein, "dense slurry" means an oil sand/hydrocarbon liquid slurry containing more than 60 wt % solids or more than 65 wt % solids. As used herein, "regular slurry" means an oil sand/hydrocarbon liquid slurry containing less than 60 wt % solids or less than 55 wt % solids.

FIG. 1 is a schematic of a process and a process line for producing a dense oil sand slurry with HS and recycled bitumen and forming a barrier between non-LS-containing vapor space in the dense slurry creation vessel and LS-containing vapor space in a downstream unit. The dense slurry can be transported for a short distance to a downstream extraction vessel containing LS.

With reference to FIG. 1, in this embodiment, mined oil sand ore is first subjected to primary sizing to a size less than about 300 mm and large tramp metal exclusion (equipment not shown here) to form loose oil sand 100. Loose oil sand is stored in hopper 110 where the loose oil sand is compressed to become compact oil sand 101. Compact oil sand 101 is transported from the bottom of hopper 110 with a conveyance apparatus 111 such as a belt feeder or a heavy plate apron feeder. Material departing the hopper passes through a rectangular cross section at the outlet and thereby creates a mostly stable material profile of compact oil sand 101. The conveyor 111 is shrouded with a non-contacting ceiling 112, and connects to a dense slurry creation vessel 113 with minimal gaps around the moving parts of the conveyor. The slurry creation vessel 113 houses equipment that enables ingestion and slurrification of arriving dense oil sand 101 and hot liquid stream 102 comprised of HS and recycled bitumen.

Both the dense oil sand 101 and hot liquid stream 102 enter the upper space 114 of vessel 113. Housed in the upper space 114 is a sizing device 123. In one embodiment, the sizing device 123 is a double-roll crusher with multiple teeth and counter rotating rolls. In one embodiment, the sizing device includes more than one-stage of the double-roll crushing, an upper double-roll crusher 120 and a lower double-roll crusher 122, with the lower crusher having a narrower gap between teeth than the upper crusher. In one embodiment, the final crushed oil sand has a size less than 100 mm. In one embodiment, the final crushed oil sand has a size less than 50 mm. Oil sand sizing is aided with evenly distributed hot liquid stream 102 containing bitumen and HS at a temperature of about 80° C. The hydrocarbon liquid 102 is introduced from the top of the vessel 113 via solvent inlet 124. Stream 102 flushes the somewhat lumpy oil sands into roll gaps where the arriving products are simultaneously dissolved, mashed, mixed, and crushed. This forced amalgamation is propelled by both gravity effects and rotational energy imparted into the counter-rotating crusher rolls. In addition to sizing, the oil sand 101 and the liquid 102 are mixed through the sizing device 123. As a result, dense slurry 103 is generated. The dense slurry is packed in the lower space 118 of the vessel 113, and in one embodiment, the lower space 118 resembles a hopper. In one embodiment, the height of the dense slurry layer is larger than 2 m.

The bitumen concentration in the liquid stream 102 is 20-30 wt % so that after complete bitumen dissolution from oil sand, the resulting hydrocarbon stream would contain about 45-50 wt % bitumen. The source of liquid 102 could be a combination of makeup HS and recycled bitumen in HS solution according to the processes taught by Canadian Patent No. 2,751,719 or Canadian Patent No. 2,895,118, incorporated herein by reference. When the oil sand feed 100 is at 4° C., the resulting dense slurry 103 is at about 29° C. and contains about 68 wt % solids. In the process of dense slurry generation, air trapped in the oil sand 101 is mostly released and its pore volume is filled with the hydrocarbon liquid.

Slurry creation vessel 113 contains less vapor space (upper space 114) than other devices such as a tumbler that are used for creating oil sand slurries. An inert gas stream 104 is introduced into vessel 113 via gas inlet 125 above the level of dense slurry 103 and dilutes the released air. In one embodiment, the inert gas is nitrogen. In another embodiment, the inert gas is $CO_2$. The mixed gas stream 105 leaves the vessel 113 via gas outlet 126 located at the top of vessel 113. In one embodiment, the oxygen concentration in mixed gas stream 105 is about 5 vol %. Some of the mixed gas can also leave the vessel 113 through gaps around the conveyor 111 to minimize air ingress. In one embodiment, this nitrogen dilution step is omitted. In one embodiment, the dense slurry contains less than 5 vol % voids. Gas inside the voids has the same composition as the mixed gas stream 105. The dense slurry layer acts as a primary barrier to prevent any gas exchange between vessel 113 and a vessel downstream. All vessels are under near ambient pressure.

The dense slurry 103 is transported in a sealed conduit 115 over a short distance into a closed vessel 116 as stream 106. In one embodiment, sealed conduit 115 is a screw conveyor. In one embodiment, the screw conveyor is inclined with the bottom part of its tube filled with dense slurry acting as a secondary barrier to prevent gas exchange between vessels 113 and 116. In one embodiment, the screw helps further degasing the dense slurry 103. The released gas is vented on top of the screw conveyor without mixing with vapor from vessel 116 (not shown in FIG. 1). In another embodiment, sealed conduit 115 comprises a positive displacement pump and a short pipeline. The pipeline is filled with dense slurry acting as a secondary barrier to prevent gas exchange between vessels 113 and 116.

In one embodiment, vessel 116 is a mixing tank which also receives a hydrocarbon stream 107 that contains LS and a water stream 108 to flocculate solids. After mixing/flocculation, vessel 116 produces regular slurry 109 which is pumped out of the vessel with a pump 117. This regular slurry 109 can be filtered to separate liquid from solids and further processed according to the processes taught by Canadian Patent No. 2,751,719 or Canadian Patent No. 2,895,118. In one embodiment, vessel 116 contains a nitrogen purge mechanism to maintain an oxygen concentration in its overhead gas lower than a limiting oxygen concentration for safe operation (not shown here). In one embodiment, regular slurry 109 is screened to remove lumps or objects larger than about 15 mm prior to filtration (no shown here). The double barriers generated by dense slurry 103 and filled portion of conduit 115 ensure no gas exchange between air-containing overhead gas in vessel 113 and LS vapor-containing overhead gas in vessel 116. The amount of nitrogen used to purge vessel 116 and the loss of LS to the purge gas are minimized owing to the double barriers.

Figure 2:
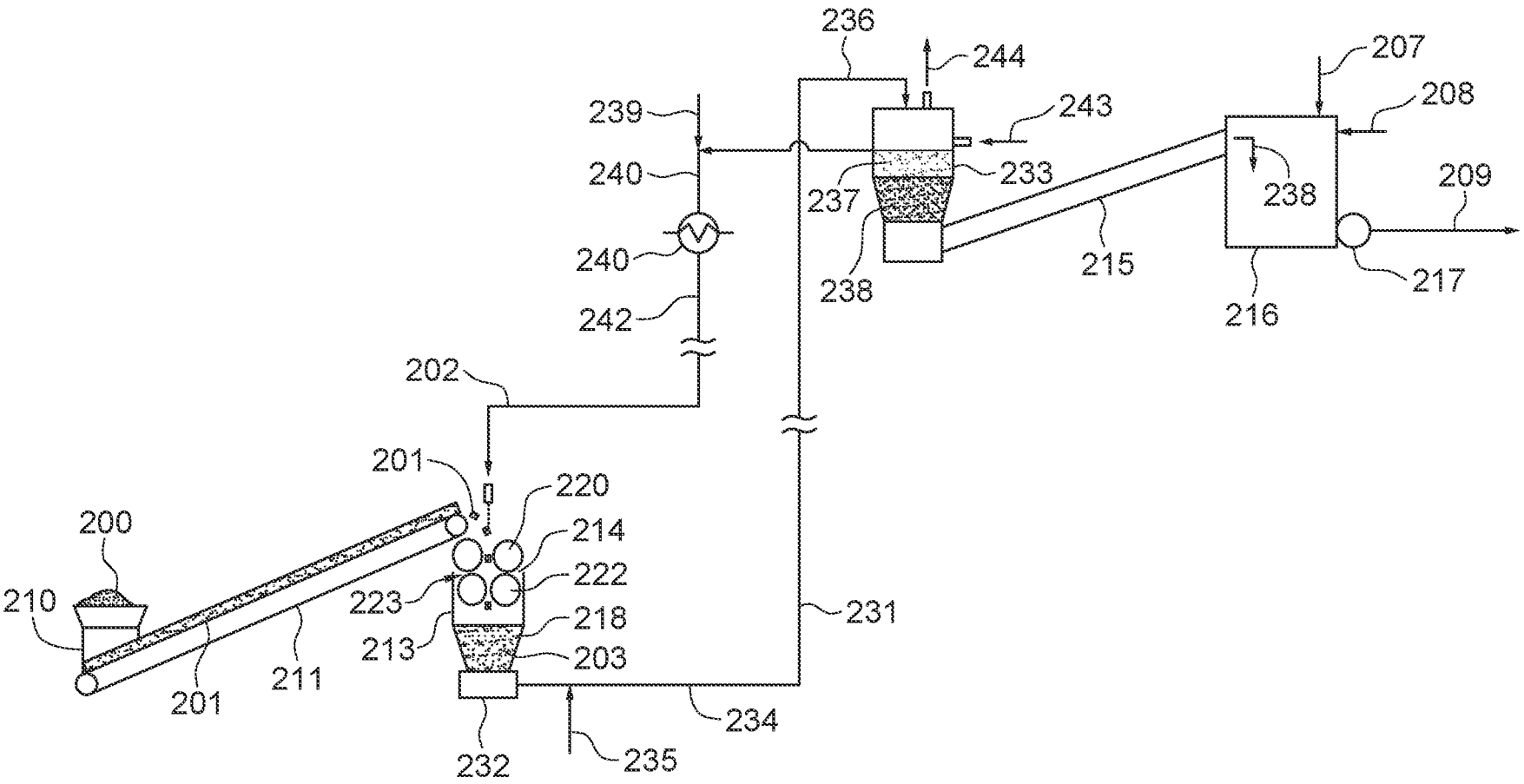
FIG. 2 is a schematic diagram of another embodiment of the present solvent extraction process.

Turning to the specific embodiment shown in FIG. 2, FIG. 2 is a schematic of another embodiment of the present invention. In particular, FIG. 2 illustrates a process and process line for sizing oil sand feed with HS and recycled bitumen to generate regular slurry with sized particles. The slurry is then pumped for a long distance to an extraction plant and forms a barrier between two vapor spaces with the entire slurry pipeline. The carrier fluid used for slurry pumping is separated and recycled and the resulting dense slurry is transported for a short distance to a downstream extraction vessel containing LS.

With reference to FIG. 2, loose oil sand 200, which has undergone primary sizing to less than about 300 mm and large tramp metal exclusion (equipment not shown here), is stored in a hopper 210. The oil sand in a form of loose or compact oil sand is transported with a conveyance apparatus 211 such as a belt feeder or a heavy plate apron feeder to an open slurry creation vessel 213 as stream 201. The slurry creation vessel 213 houses equipment that enables ingestion and slurrification of arriving oil sand 201 and hot liquid stream 202. Stream 202 comprises HS and bitumen. The combined product, regular slurry 203, arrives by gravity into the vessel bottom 218.

In one embodiment, a sizing device 223 is housed in the upper space 214 of the vessel 213. In one embodiment, the sizing device is a double-roll crusher with multiple teeth and counter rotating rolls. In one embodiment, the sizing device includes more than one-stage of the double-roll crushing and comprises an upper double-roll crusher 220 and a lower double-roll crusher 222, with the lower crusher 222 having a narrower gap between teeth than the upper crusher 220. In one embodiment, the final crushed oil sand has a size less than 100 mm. In one embodiment, the final crushed oil sand has a size less than 50 mm. Oil sand sizing is aided with evenly distributed hot liquid stream 202 containing bitumen and HS at a temperature of about 80° C. The hydrocarbon liquid 202 is introduced above the sizing device 223. Stream 202 flushes the somewhat lumpy oil sands into roll gaps where the arriving products are simultaneously dissolved, mashed, mixed, and crushed. This forced amalgamation is propelled by both gravity effects and rotational energy imparted into the counter-rotating crusher rolls. In addition to sizing, the oil sand 201 and the liquid 202 are mixed through the sizing device 223. As a result, regular slurry 203 is generated.

The bitumen concentration in the liquid 202 is 35-45 wt % so that after complete bitumen dissolution from oil sand, the resulting hydrocarbon stream contains about 45-50 wt % bitumen. When the oil sand feed 200 is at 4° C., the resulting regular slurry 203 is at about 44° C. and contains about 55 wt % solids. In the process of slurry generation, air trapped in the oil sand 201 is released and its pore volume is filled with the hydrocarbon liquid 202. The regular slurry is packed in the lower space 218 of the vessel 213 that resembles a hopper. In one embodiment, the height of the regular slurry layer is larger than 2 m. The regular slurry layer acts as a primary barrier to prevent any gas exchange between vessel 213 and a vessel downstream. All vessels are under near ambient pressure.

In one embodiment, the regular slurry 203 is pumped with a slurry pump 232 through a pipeline 231 over a long distance from a mine site to an extraction plant and is discharged into a closed vessel 233 in the extraction plant. Since the pumped slurry 234 contains no flammable hydrocarbons, it is safe to manage pipeline leaks and spills. There is also no need to handle flammable solvents in the mine. The pumped slurry 234 and the pipeline 231 contain almost no gas pockets. Therefore, the entire pipeline 231 acts as a secondary barrier to prevent gas exchange between vessels 213 and 233. In one embodiment, a water stream 235 is added to the regular slurry 234 near the pump 232 to flocculate solids during the pipeline transport. The slurry stream 234 becomes slurry 236 at the end of the pipeline 231.

Vessel 233 is a settler to settle out solids in the regular slurry 236 and a separator to decant hydrocarbon supernatant 237 from top. The solids-rich mixture forms dense slurry 238 on the bottom of vessel 233. Hydrocarbon supernatant 237 is combined with a liquid stream 239 to become stream 240. The bitumen concentration in the liquid 239 is 20-30 wt %. The remaining part is HS. The source of liquid 239 could be a combination of makeup HS and recycled bitumen in HS solution according to the processes taught by Canadian Patent No. 2,751,719 or Canadian Patent No. 2,895,118. Stream 240 passes through a heat exchanger 241 to become hot hydrocarbon stream 242 at about 80° C. Depending on the temperature of stream 239, the heat exchanger could be a cooler or a heater to maintain the temperature of stream 242 around 80° C. The stream 242 is pumped over a long distance from the extraction plant back to the mine and becomes stream 202 that is used in wet sizing and regular slurry preparation. The vapor space of vessel 233 is flushed with an inert gas stream 243 to drive out any residual air in slurry 236. The mixed gas leaves the vessel 233 as stream 244. In one embodiment, the inert gas is nitrogen.

Dense slurry 238 is removed from the bottom of vessel 233 and transported in a sealed conduit 215 over a short distance into a closed vessel 216 as stream 238. The dense slurry 238 and the hydrocarbon supernatant 237 form a primary barrier between the vapor spaces of vessels 233 and 216. In one embodiment, the dense slurry 238 is transported with a screw conveyor. In one embodiment, the screw conveyor is inclined with the bottom part of its tube filled with dense slurry acting as a secondary barrier to prevent gas exchange between vessels 233 and 216. The dense slurry 238 contains about 68 wt % solids.

In one embodiment, vessel 216 is a mixing tank which also receives a hydrocarbon stream 207 that contains LS and a water stream 208 to flocculate solids. After mixing/flocculation, vessel 216 produces regular slurry 219 which is pumped out of the vessel with a pump 217. This regular slurry 219 can be filtered to separate liquid from solids and further processed according to the processes taught by Canadian Patent No. 2,751,719 or Canadian Patent No. 2,895,118. In one embodiment, vessel 216 contains a nitrogen purge mechanism to maintain an oxygen concentration in its overhead gas lower than the limiting oxygen concentration for safe operation (not shown in FIG. 2). The amount of nitrogen used to purge vessel 216 and the loss of LS to the purge gas are minimized owing to the multiple barriers mentioned above. In one embodiment, regular slurry 219 is screened to remove lumps or objects larger than about 15 mm prior to filtration (not shown here).

Figure 3:
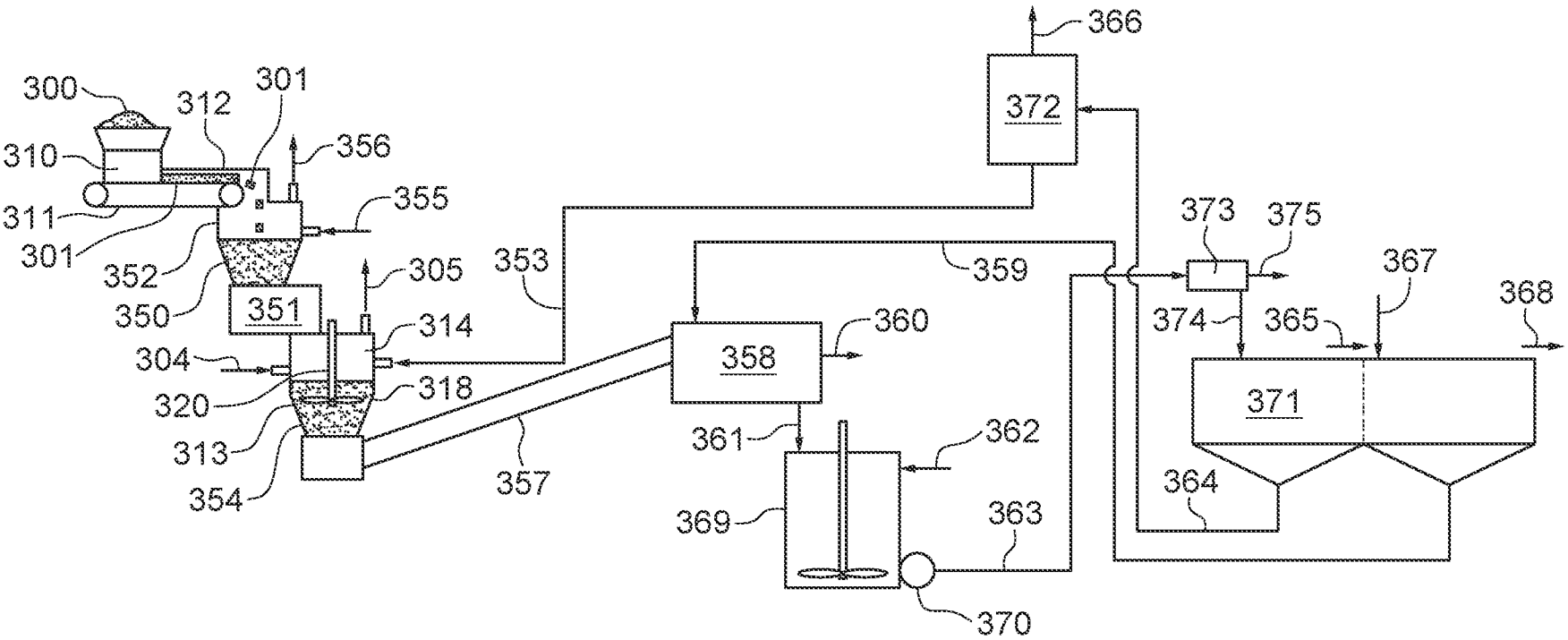
FIG. 3 is a schematic diagram of another embodiment of the present solvent extraction process.

FIG. 3 is a schematic of another embodiment of a process and process line of the present invention. In particular, FIG. 3 illustrates a process to size dry oil sand feed, form a partial barrier with dry oil sand between ambient air and a pre-purge chamber, form another partial barrier with dry oil sand between the pre-purge chamber and a low-LS-content vapor space below, generate cold dense slurry with a bitumen-rich LS stream in the low-LS-content vapor space, form a barrier with the cold dense slurry between the low-LS-content vapor space and a high-LS-content vapor space downstream, and transport the dense slurry for a short distance to a downstream extraction vessel containing the high-LS-content vapor space and receiving a bitumen-lean LS stream.

With reference to FIG. 3, loose oil sand 300, after sizing to less than about 300 mm and large tramp metal exclusion (equipment not shown here), is stored in a hopper 310. In one embodiment, oil sand 300 has gone through multiple stages of sizing to a top size less than 150 mm (not shown here). The oil sand is compressed in the hopper 310 to become compact oil sand 301 and is transported from the bottom of hopper 310 with a conveyance apparatus 311 such as a belt feeder, or a heavy plate apron feeder. Material departing the hopper passes through a rectangular cross section at the outlet and thereby creates a mostly stable material profile of oil sand 301. The conveyor 311 is shrouded with a non-contacting ceiling 312, and connects to a semi-closed vessel 352 with minimal gaps around the moving parts of the conveyor.

The semi-closed vessel 352 is used as a pre-purge chamber. An inert gas stream 355 enters vessel 352. In one embodiment, the inert gas is nitrogen. When oil sand 301 is discharged from the conveyor 311, some air pockets present in the oil sand open up and mix with the inert gas stream. The inert gas stream carries some of the air out of the semi-closed vessel 352 in a mixed gas stream 356. Some mixed gas stream leaves semi-closed vessel 352 through gaps around the conveyor 311 to minimize air ingress. The inert-gas-flushed oil sand 350 forms an oil sand layer on the bottom of semi-closed vessel 352 that resembles a hopper. In one embodiment, the oil sand layer is more than 2 m in height.

The oil sand 350 is transported through a rate-regulating device 351 into vessel 313, which is a closed vessel. In one embodiment, the rate-regulating device 351 is a short horizontal belt feeder through a sealed conduit. In one embodiment, the device 351 is a short horizontal screw conveyor. In one embodiment, the device 351 is a short vertical screw (auger). In one embodiment, the device 351 is a rotary valve. Lacking a liquid seal, the dry oil sand layer 350 and the device 351 form a partial barrier between the vapor spaces of semi-closed vessel 352 and closed vessel 313. A low-explosive-limit (LEL) detector and an alarm are installed in vessel 352 to ensure safe operation. All vessels including vessels 352 and 313 are operated under near ambient pressure.

Vessel 313 comprises an overhead space 314 and a bottom space 318. A bitumen-rich LS stream 353 is introduced into overhead space 314 of vessel 313 to form dense slurry 354 with dry oil sand 350. In one embodiment, stream 353 contains 45 wt % bitumen and 55 wt % LS. After complete bitumen dissolution from oil sand, the resulting hydrocarbon stream would contain about 63 wt % bitumen. The temperature of the stream 353 is about 42° C. When the oil sand feed 300 is at 4° C., the resulting dense slurry 354 is at about 14° C. and contains about 70 wt % solids. Oil sand 350 feeding into vessel 313 contains air pockets not eliminated in vessel 352. In the process of dense slurry generation, air trapped in the oil sand 350 is mostly released and its pore volume is filled with the hydrocarbon liquid. An inert gas stream 304 is introduced to the overhead space 314 above the level of dense slurry 354 and dilutes the released air. In one embodiment, the inert gas is nitrogen. In one embodiment, an agitation device 320 is inserted into the bottom space 318 of vessel 313 to promote formation of dense slurry 354. The speed of device 320 is kept slow to allow mixing and release of gas bubbles from oil sand 350 while not generating vortex that may entrain gas from the vapor space 314 into dense slurry 354.

A mixed gas stream 305 leaves the overhead space 314 via an outlet. In one embodiment, gas stream 305 is sent to a flare or a furnace to combust its LS vapor. The oxygen concentration in gas stream 305 is controlled to be lower than the limiting oxygen concentration (about 5 vol %) for safe operation of vessel 313. Because of a high bitumen concentration (about or above 60 wt %) and a low temperature in the dense slurry, the vapor pressure of LS in the vapor space of overhead space 314 is low. Loss of LS vapor in stream 305 is minimal. Escape of LS vapor through the partial barrier into overhead space 314 is negligible, so the LEL alarm in vessel 352 is unlikely to be triggered.

The dense slurry 354 is packed in the bottom space 318. In one embodiment, the height of the dense slurry layer is greater than 2 m. In one embodiment, the dense slurry 354 contains less than 1 vol % voids. Gas inside the voids has the same composition as the mixed gas stream 305. The dense slurry layer acts as a primary barrier to prevent any gas exchange between vessel 313 and a vessel downstream.

The dense slurry 354 is transported in a sealed conduit 357 over a short distance into a closed vessel 358. In one embodiment, the dense slurry 354 is transported with a screw conveyor. In one embodiment, the screw conveyor is inclined with the bottom part of its tube filled with dense slurry acting as a secondary barrier to prevent gas exchange between vessels 313 and 358. In one embodiment, the screw helps further degasing the dense slurry 354. The released gas is vented on top of the screw conveyor without mixing with vapor from vessel 358 (not shown in FIG. 3). In another embodiment, the dense slurry 354 is pumped with a positive displacement pump through a short pipeline. The pipeline is filled with dense slurry acting as a secondary barrier to prevent gas exchange between vessels 313 and 358.

Vessel 358 is an agitation vessel to further dilute bitumen in dense slurry 354 with a bitumen-lean LS stream 359. In one embodiment, stream 359 contains about 31 wt % bitumen and 69 wt % LS. After complete mixing, the resulting hydrocarbon stream contains about 45 wt % bitumen. Vessel 358 contains a screen to reject oversized lumps 360. In one embodiment, the reject solids are larger than 50 mm. In one embodiment, part of stream 359 is directed at the screen to wash the reject solids. The reject stream 360 is transferred to a solids dryer in a sealed conduit to recover its LS component prior to disposal according to the process taught by Canadian Patent No. 2,794,373, incorporated herein by reference.

The screened slurry becomes regular slurry 361. Temperature is raised from about 14° C. in dense slurry 354 to about 35-50° C. in regular slurry 361. Means of heating is either by preheating the stream 359 or by installing heat exchanging device in vessel 358 or the combination of both. In one embodiment, vessel 358 is a sealed tumbler with a rotary screen at its end. In one embodiment, vessel 358 contains a nitrogen purge mechanism to maintain an oxygen concentration in its overhead gas lower than the limiting oxygen concentration for safe operation (not shown in FIG. 3). Compared to the top space 314 of vessel 313, LS vapor pressure in vessel 358 is higher due to lower bitumen concentration in hydrocarbon phase and higher temperature. The double barriers made of cold dense slurry 354 in bottom space 318 and conduit 357 ensure no gas exchange between vapor spaces of vessel 313 and vessel 358. In addition, dense slurry 354 carries almost no trapped air. Therefore, the amount of nitrogen used to purge vessel 358 and the loss of LS to the purge gas are minimized.

Regular slurry 361 is transferred to an agitation vessel 369 to mix with a water stream 362 to flocculate solids and produce flocculated slurry 363. In one embodiment, vessel 358 is skipped. Streams 354, 359 and 362 are mixed and flocculated in vessel 369 in one step without any reject stream. Vessel 369 is heated through a heat exchanging device to raise the temperature of slurry 363 to 50° C. In one embodiment, vessel 369 is a mixing tank with impellers according to the process taught by Canadian Patent No. 2,895,118. In one embodiment, vessel 369 contains a nitrogen purge mechanism to maintain an oxygen concentration in its overhead gas lower than the limiting oxygen concentration for safe operation (not shown in FIG. 3).

Slurry 363 is pumped out of the vessel 369 with a slurry pump 370 into another screen 373. In one embodiment, screen 373 rejects lumps or objects larger than about 15 mm. In one embodiment, screen 373 rejects lumps or objects larger than about 10 mm. The reject stream 375 is transferred to a solids dryer in a sealed conduit to recover its LS component prior to disposal according to the process taught by Canadian Patent No. 2,794,373, incorporated herein by reference. In one embodiment, unit 373 is a sealed rotary screen. In one embodiment, screen 373 is skipped.

Screened slurry 374 exits unit 373 and is transported onto a two-stage solid-liquid separator 371. In one embodiment, separator 371 is an enclosed horizontal vacuum filter with two drainage stages. The first stage of separator 371 generates a mother liquor 364 and a cake stream 365. In one embodiment, mother liquor 364 contains 45 wt % bitumen and 55 wt % LS at 42° C. Mother liquor 364 is split in a vessel 372 to become streams 353 and 366. In one embodiment, vessel 372 is a gravity settler to separate the stream 353 containing coarse solids and large water drops from its cleaner product stream 366. In one embodiment, vessel 372 contains inclined plates to enhance settling.

Stream 353 is the bitumen-rich LS stream that is recycled to vessel 313 to make dense slurry 354. Stream 366 is pumped to a distillation unit to recover LS and produce dry bitumen product. The cake stream 365 is moved to the second stage of separator 371 where a LS stream 367 is introduced to wash the cake. The second stage generates a drained wash liquid stream 359 and a washed cake stream 368. In one embodiment, stream 359 contains 31 wt % bitumen and 69 wt % LS. Stream 359 is the bitumen-lean LS stream that is recycled to vessel 358 to make regular slurry 361. In one embodiment, stream 367 is pure LS and washed cake 368 moves to a solids dryer to recover residual LS according to the process taught by Canadian Patent No. 2,794.373. In one embodiment, there is another mixing vessel (or a repulper), another screen and another two-stage separator similar to units 369, 370, 371 and 373 to further process cake 368 (not shown in FIG. 3). The screen reject stream 375 is transferred to the repulper for further ablation. Pure LS is introduced at the second stage of the second separator and moves countercurrent to solid cake stream. The washed cake from the second separator, combined with the oversized materials from the second screen, is transferred to a solids dryer according to the process taught by Canadian Patent No. 2,794.373.

EXAMPLE 1

A loose oil sand contained 8.8 wt % bitumen, 5.3 wt % water and 85.9 wt % solids. The fines (<44 μm) content in the solids was 42%. 50 g of such oil sand was mixed with 13 g of hydrocarbons containing 32 wt % bitumen and 68 wt % virgin light gas oil (a heavy solvent) through brief shaking of the sample bottle by hand at room temperature. The resulting dense slurry contained 68 wt % solids. The bitumen concentration in the hydrocarbons after complete dissolution would be 49 wt %. The slurry was transferred to a 50 mL graduated cylinder. The height of the slurry was 10 cm. The density of the slurry was determined by weighing the graduated cylinder and measuring the slurry volume to be 1626 kg/m$^3$. Based on the theoretical density of such slurry (1676 kg/m$^3$), it was calculated that the voidage in such slurry was 3 vol %. The entrained air was merely 0.0028 wt % of the oil sand mass. The experiment shows that making such dense slurry with a heavy solvent is an effective way for deaerating oil sands.

EXAMPLE 2

A loose oil sand contained 9.9 wt % bitumen, 5.2 wt % water and 84.9 wt % solids. The fines (<44 μm) content in the solids was 22%. 491 g of such oil sand was mixed with 105 g of hydrocarbons containing 49 wt % bitumen and 51 wt % light naphtha (mainly aliphatic $C_6$-$C_9$) through brief stirring with a rod at room temperature in a 1 L graduated cylinder. The resulting dense slurry contained 70 wt % solids. The bitumen concentration in the hydrocarbons after complete dissolution would be 65 wt %. The height of the slurry was 12 cm. The density of the slurry was determined by weighing the graduated cylinder and measuring the slurry volume to be 1656 kg/m$^3$. Based on the theoretical density of such slurry (1667 kg/m$^3$), it was calculated that the voidage in such slurry was 0.7 vol %. The experiment shows that making such dense slurry with a concentrated bitumen in light naphtha solution is a highly effective way for deaerating oil sands.

EXAMPLE 3

An oil sand contained 8.9 wt % bitumen, 6.3 wt % water and 84.8 wt % solids. The fines (<44 μm) content in the solids was 28%. 750 g of such oil sand was used in two experiments. In the first one, the oil sand was mixed with hydrocarbons containing 23.4 wt % bitumen, 38.3 wt % virgin light gas oil and 38.3 wt % heptane. In the second one, the oil sand was mixed with hydrocarbons containing 28.8 wt % bitumen and 71.2 wt % light naphtha (mainly aliphatic $C_6$-$C_9$). The slurry was flocculated with 22 g added water in the mixing tank in each case. The slurry was filtered on a batch vacuum filter and washed with solvent-rich hydrocarbon liquids prepared based on countercurrent solvent wash modelling. There were four drainage stages in each case. The vacuum was set at −0.17 bar for each stage. Filter cake was repulped with a hydrocarbon liquid between the second and the third drainage stages. The final wash liquids at the fourth drainage stage comprise 225 g heptane and 208 g light naphtha for the two experiments, respectively. Bitumen recoveries were 93.3% for the light gas oil+heptane experiment and 93.5% for the light naphtha experiment. In the first experiment, there was a further 3% loss of light gas oil that needs to be recovered in a solids dryer. Therefore, bitumen extraction with light naphtha alone is at least as effective as extraction with the two solvents.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a process for forming a deaerated oil sand slurry, comprising (a) providing a first vessel having an overhead space and a bottom space; (b) delivering oil sand and a low vapor pressure hydrocarbon liquid into the overhead space and mixing the oil sand and hydrocarbon liquid to release air trapped in the oil sand and form the deaerated slurry; (c) optionally adding an inert gas stream to the overhead space to displace the air released from the oil sand; and (d) collecting the deaerated slurry in the bottom space to form a slurry layer to prevent gas exchange between the first vessel and downstream extraction equipment.

Clause 2, the process of clause 1, wherein the hydrocarbon liquid is a mixture of a heavy solvent (HS) and bitumen.

Clause 3, the process of clause 1, wherein the hydrocarbon liquid is a mixture of a heavy solvent (HS), a light solvent (LS) and bitumen.

Clause 4, the process of clause 1, wherein the hydrocarbon liquid is a mixture of a light solvent (LS) and bitumen.

Clause 5, the process of clause 1, wherein the first vessel is a semi-closed vessel and the hydrocarbon liquid is a mixture of a heavy solvent (HS) and bitumen.

Clause 6, the process of clause 5, wherein the semi-closed vessel comprises a sizing device in the overhead space.

Clause 7, the process of clause 6, wherein the sizing device comprises at least one double roll crusher.

Clause 8, the process of clause 7, wherein the semi-closed vessel has a hopper-like bottom.

Clause 9, the process of clause 1, wherein the height of the slurry layer is at least 2 m.

Clause 10, the process of clause 5, further comprising (e) transporting the deaerated slurry from the bottom space of the semi-closed vessel with a sealed conduit to a second vessel.

Clause 11, the process of clause 10, wherein the sealed conduit is an inclined screw conveyor.

Clause 12, the process of clause 10, wherein the sealed conduit comprises a positive displacement pump and a pipeline.

Clause 13, the process of clause 10, wherein the deaerated slurry in the sealed conduit acts as a barrier to prevent gas exchange between the semi-closed vessel and the second vessel.

Clause 14, the process of clause 10, wherein the second vessel is a mixing tank.

Clause 15, the process of clause 1, wherein the first vessel is an open vessel and the hydrocarbon liquid is a mixture of a heavy solvent (HS) and bitumen.

Clause 16, the process of clause 15, wherein the open vessel comprises a sizing device in the overhead space.

Clause 17, the process of clause 16, wherein the sizing device comprises at least one double roll crusher.

Clause 18, the process of clause 17, wherein the open vessel has a hopper-like bottom.

Clause 19, the process of clause 15, further comprising (e) transporting the deaerated slurry from the bottom space of the open vessel to a second vessel.

Clause 20, the process of clause 19, wherein the second vessel is a closed vessel.

Clause 21, the process of clause 19, wherein the closed vessel is a settler/separator for settling out solids in the deaerated slurry to form a dense slurry and separating a hydrocarbon supernatant for recycling back to the open vessel.

Clause 22, the process of clause 19, wherein the deaerated slurry is transported by a slurry pump and a pipeline.

Clause 23, the process of clause 15, wherein the slurry layer acts as a barrier to prevent gas exchange between the first vessel and the second vessel.

Clause 24, the process of clause 15, wherein the slurry layer is at least 2 m.

Clause 25, the process of clause 22, wherein the pumped deaerated slurry and pipeline act as a barrier to prevent gas exchange between the first vessel and the second vessel.

Clause 26, the process of clause 21, further comprising (f) transporting the dense slurry from the settler/separator to a third vessel.

Clause 27, the process of clause 26, wherein the third vessel is a closed vessel.

Clause 28, the process of clause 26, wherein the dense slurry is removed from the settler/separator and transported to the third vessel by means of an inclined screw.

Clause 29, the process of clause 26, wherein the settler/separator comprises a hopper-like bottom to retain a level of dense slurry.

Clause 30, the process of clause 29, wherein the level of dense slurry acts as a barrier to prevent gas exchange between the second vessel and the third vessel.

Clause 31, the process of clause 27, wherein the third vessel is a mixing tank.

Clause 32, the process of clause 31, wherein a hydrocarbon stream comprising light solvent and water is added to the dense slurry to flocculate solids therein.

Clause 33, the process of clause 29, wherein the level of dense slurry is at least 2 m.

Clause 34, the process of clause 1, wherein the first vessel is a closed vessel.

Clause 35, the process of clause 34, further comprising crushing the oil sand and delivering the oil sand into a pre-purge chamber upstream of the first vessel.

Clause 36, the process of clause 35, wherein the pre-purge chamber is a semi-closed vessel.

Clause 37, the process of clause 36, wherein an inert gas is added to the pre-purge chamber.

Clause 38, the process of clause 37, wherein the pre-purge chamber has a hopper-like bottom.

Clause 39, the process of clause 37, wherein the oil sand in the pre-purge chamber is delivered to the overhead space of the first vessel by means of a rate-regulating device.

Clause 40, the process of clause 39, wherein the rate-regulating device is a sealed belt feeder.

Clause 41, the process of clause 39, wherein the rate-regulating device is a screw conveyor.

Clause 42, the process of clause 39, wherein the rate-regulating device is a vertical auger.

Clause 43, the process of clause 39, wherein the rate-regulating device is a rotary valve.

Clause 44, the process of clause 34, wherein the inert gas stream is added to the overhead space of the first vessel.

Clause 45, the process of clause 44, wherein the low vapor pressure hydrocarbon liquid (the first hydrocarbon liquid) comprises bitumen and a light solvent (LS).

Clause 46, the process of clause 45, wherein the temperature of the deaerated slurry in the first vessel is below 20° C.

Clause 47, the process of clause 34, further comprising (e) transporting the deaerated slurry in a sealed conduit to a second vessel.

Clause 48, the process of clause 47, wherein the sealed conduit is a screw conveyor.

Clause 49, the process of clause 47, wherein the sealed conduit comprises a positive displacement pump and a pipeline.

Clause 50, the process of clause 47, wherein the second vessel is a closed vessel.

Clause 51, the process of clause 47, wherein the second vessel is a closed agitation vessel.

Clause 52, the process of clause 51, further comprising (f) adding a second hydrocarbon liquid comprising bitumen and light solvent (LS) to the second vessel for mixing with the deaerated slurry to form a mixed diluted slurry.

Clause 53, the process of clause 52, wherein the second vessel has a screen, further comprising (g) screening the mixed diluted slurry to form a regular slurry.

Clause 54, the process of clause 53, wherein the regular slurry has a top size less than about 50 mm.

Clause 55, the process of clause 52, wherein the mixed diluted slurry is heated to about 35-50° C.

Clause 56, the process of clause 47, wherein the second vessel is a sealed tumbler with a rotary screen at its end.

Clause 57, the process of clause 53, further comprising (h) transporting the regular slurry to a third vessel.

Clause 58, the process of clause 57, wherein the third vessel is a mixing tank.

Clause 59, the process of clause 58, wherein water is added to the regular slurry to flocculate solids therein.

Clause 60, the process of clause 58, wherein the regular slurry is heated to about 50° C.

Clause 61, the process of clause 57, further comprising (i) transporting the regular slurry to a fourth vessel.

Clause 62, the process of clause 61, wherein the fourth vessel is a screen and a screened slurry is produced.

Clause 63, the process of clause 61, wherein the screened slurry has a top size less than about 15 mm.

Clause 64, the process of clause 62, further comprising (j) transporting the screened slurry to a fifth vessel.

Clause 65, the process of clause 64, wherein the fifth vessel is a horizontal vacuum filter with two drainage stages.

Clause 66, the process of clause 65, wherein the first drainage stage produces a filtrate that is partially recycled as the first hydrocarbon liquid, and the second drainage stage receives a first wash liquid, produces a filtrate that is recycled as the second hydrocarbon liquid and produces a first filter cake.

Clause 67, the process of clause 65, wherein part of the first stage filtrate is the bitumen product.

Clause 68, the process of clause 65, further comprising (k) transporting the first filter cake to a sixth vessel.

Clause 69, the process of clause 68, wherein the sixth vessel is a mixing tank (repulper).

Clause 70, the process of clause 69, wherein a third hydrocarbon liquid comprising bitumen and light solvent (LS) is added to the mixing tank to produce a repulped slurry.

Clause 71, the process of clause 70, wherein the repulped slurry is heated to about 50° C.

Clause 72, the process of clause 62, wherein the oversized material from the screen is transported through a sealed conduit to the sixth vessel for further ablation.

Clause 73, the process of clause 70, further comprising (l) transporting the repulped slurry to a seventh vessel.

Clause 74, the process of clause 73, wherein the seventh vessel is a screen and a screened slurry is produced.

Clause 75, the process of clause 74, wherein the screened slurry has a top size less than about 15 mm.

Clause 76, the process of clause 74, further comprising (m) transporting the screened slurry to an eighth vessel.

Clause 77, the process of clause 76, wherein the eighth vessel is a horizontal vacuum filter with two drainage stages.

Clause 78, the process of clause 77, wherein the first drainage stage produces a filtrate that is recycled as the first wash liquid in the fifth vessel, and the second drainage stage receives a second wash liquid, produces a filtrate that is recycled as the third hydrocarbon liquid in the sixth vessel and produces a second filter cake.

Clause 79, the process of clause 78, wherein the second wash liquid is pure LS.

Clause 80, the process of clause 78, further comprising (n) transporting the second filter cake to a ninth vessel.

Clause 81, the process of clause 80, wherein the ninth vessel is a solids dryer that removes and recovers LS from the second filter cake.

Clause 82, the process of clause 53, wherein the oversized material from the screen is transported through a sealed conduit to the solids dryer to recover residual LS.

Clause 83, the process of clause 74, wherein the oversized material from the screen is transported through a sealed conduit to the solids dryer to recover residual LS.

Clause 84, the process of any of clauses 2 to 4, wherein the HS is non-volatile, high-flash point light gas oil stream, distilled from oil sand bitumen, and has a boiling range of about 130° C. to about 470° C.

Clause 85, the process of any of clauses 2 to 4, wherein the LS is predominantly aliphatic $C_6$-$C_9$ hydrocarbon stream produced from an oil sand bitumen upgrading unit, and has a boiling range of about 60° C. to about 160° C.

Clause 86, the process of any of clauses 2 to 4, wherein the LS is aliphatic $C_6$-$C_7$ hydrocarbons, and has a boiling range of about 69° C. to about 110° C.

Interpretation.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

What is claimed is:

1. A process for forming a deaerated oil sand slurry, comprising:

(a) providing a first vessel, said first vessel being an open vessel having an overhead space and a bottom space;

(b) delivering oil sand and a low vapor pressure hydrocarbon liquid comprising a mixture of a heavy solvent (HS) and bitumen into the overhead space and mixing the oil sand and hydrocarbon liquid in the first vessel to release air trapped in the oil sand and form the deaerated slurry;

(c) optionally adding an inert gas stream to the overhead space to displace the air released from the oil sand;

(d) collecting the deaerated slurry in the bottom space to form a slurry layer to prevent gas exchange between the first vessel and downstream extraction equipment; and (e) transporting the deaerated slurry from the bottom space of the open vessel to a second vessel, said second vessel being a closed vessel;

wherein the second vessel is a settler/separator for settling out solids in the deaerated slurry to form a dense slurry and separating a hydrocarbon supernatant for recycling back to the open vessel.

2. The process of claim 1, wherein the deaerated slurry is transported by a slurry pump and a pipeline.

3. The process of claim 2, wherein the pumped deaerated slurry and pipeline act as a barrier to prevent gas exchange between the first vessel and the second vessel.

4. The process of claim 1, wherein the slurry layer is at least 2 m.

5. The process of claim 1, further comprising:

(f) transporting the dense slurry from the second vessel to a third vessel.

6. The process of claim 5, wherein the third vessel is a closed vessel.

7. The process of claim 6, wherein the third vessel is a mixing tank.

8. The process of claim 7, wherein a hydrocarbon stream comprising light solvent and water is added to the dense slurry to flocculate solids therein.

9. The process of claim 5, wherein the dense slurry is removed from the second vessel and transported to the third vessel by means of an inclined screw.

10. The process of claim 5, wherein the second vessel comprises a hopper-like bottom to retain a level of dense slurry.

11. The process of claim 10, wherein the level of dense slurry acts as a barrier to prevent gas exchange between the second vessel and the third vessel.

12. The process of claim 10, wherein the level of dense slurry is at least 2 m.

13. The process as claimed in claim 1, wherein the inert gas stream is added to the overhead space of the first vessel.

14. The process of claim 1, wherein the first vessel comprises at least one double roll crusher in the overhead space for sizing the oil sand.

15. The process of claim 1, wherein the first vessel has a hopper-like bottom.

16. A process for forming a deaerated oil sand slurry, comprising:

(a) providing a first vessel, said first vessel being a closed vessel having an overhead space and a bottom space;

(b) delivering oil sand and a low vapor pressure hydrocarbon liquid comprising bitumen and a light solvent (LS) into the overhead space and mixing the oil sand and hydrocarbon liquid in the first vessel to release air trapped in the oil sand and form the deaerated slurry;

(c) optionally adding an inert gas stream to the overhead space to displace the air released from the oil sand; and (d) collecting the deaerated slurry in the bottom space to form a slurry layer to prevent gas exchange between the first vessel and downstream extraction equipment;

wherein the temperature of the deaerated slurry in the first vessel is below 20° C.

17. The process of claim 16, further comprising:

(e) transporting the deaerated slurry in a sealed conduit to a second vessel.

18. The process of claim 17, wherein the sealed conduit is a screw conveyor.

19. The process of claim 17, wherein the sealed conduit comprises a positive displacement pump and a pipeline.

20. The process of claim 17, wherein the second vessel is a closed vessel.

21. The process of claim 17, wherein the second vessel is a closed agitation vessel.

22. The process of claim 21, further comprising:

(f) adding a second hydrocarbon liquid comprising bitumen and light solvent (LS) to the second vessel for mixing with the deaerated slurry to form a mixed diluted slurry.

23. The process of claim 16, further comprising crushing the oil sand and delivering the oil sand into a pre-purge chamber upstream of the first vessel.

24. The process of claim 23, wherein the pre-purge chamber is a semi-closed vessel.

25. The process of claim 24, wherein an inert gas is added to the pre-purge chamber.

26. The process of claim 25, wherein the pre-purge chamber has a hopper-like bottom.

27. The process of claim 23, wherein the oil sand in the pre-purge chamber is delivered to the overhead space of the first vessel by means of a sealed belt feeder.

28. The process of claim 23, wherein the oil sand in the pre-purge chamber is delivered to the overhead space of the first vessel by means of a screw conveyor.

29. The process of claim 23, wherein the oil sand in the pre-purge chamber is delivered to the overhead space of the first vessel by means of a vertical auger.

30. The process of claim 23, wherein the oil sand in the pre-purge chamber is delivered to the overhead space of the first vessel by means of a rotary valve.

31. A process for forming a deaerated oil sand slurry, comprising:

(a) providing a first vessel, said first vessel being a closed vessel having an overhead space and a bottom space;

(b) delivering oil sand and a low vapor pressure hydrocarbon liquid into the overhead space and mixing the oil sand and hydrocarbon liquid in the first vessel to release air trapped in the oil sand and form the deaerated slurry;

(c) optionally adding an inert gas stream to the overhead space to displace the air released from the oil sand;

(d) collecting the deaerated slurry in the bottom space to form a slurry layer to prevent gas exchange between the first vessel and downstream extraction equipment;

(e) transporting the deaerated slurry in a sealed conduit to a second vessel, said second vessel being a closed agitation vessel and having a screen;

(f) adding a second hydrocarbon liquid comprising bitumen and light solvent (LS) to the second vessel for mixing with the deaerated slurry to form a mixed diluted slurry; and (g) screening the mixed diluted slurry to remove oversized material and form a regular slurry.

32. The process of claim 31, wherein the regular slurry has a top size less than about 50 mm.

33. The process of claim 22, wherein the mixed diluted slurry is heated to about 35-50° C.

34. The process of claim 31, further comprising:

(h) transporting the regular slurry to a third vessel.

35. The process of claim 34, wherein the third vessel is a mixing tank.

36. The process of claim 35, wherein water is added to the regular slurry to flocculate solids therein.

37. The process of claim 35, wherein the regular slurry is heated to about 50° C.

38. The process of claim 34, further comprising:

(i) transporting the regular slurry to a fourth vessel.

39. The process of claim 38, wherein the fourth vessel is a screen and a screened slurry is produced.

40. The process of claim 39, further comprising:

(j) transporting the screened slurry to a fifth vessel.

41. The process of claim 40, wherein the fifth vessel is a horizontal vacuum filter with two drainage stages.

42. The process of claim 41, wherein the first drainage stage produces a filtrate that is partially recycled as the low vapor pressure hydrocarbon liquid, and the second drainage stage receives a first wash liquid, produces a filtrate that is recycled as the second hydrocarbon liquid and produces a first filter cake.

43. The process of claim 42, wherein part of the first stage filtrate is a bitumen product.

44. The process of claim 39, wherein the oversized material from the screen is transported through a sealed conduit to a solids dryer to recover any entrained LS on the oversized material.

45. The process of claim 38, wherein the screened slurry has a top size less than about 15 mm.

46. The process of claim 31, wherein the oversized material from the screen is transported through a sealed conduit to a solids dryer to recover any entrained LS on the oversized material.

47. A process for forming a deaerated oil sand slurry, comprising:

(a) providing a first vessel, said first vessel being a closed vessel having an overhead space and a bottom space;

(b) delivering oil sand and a low vapor pressure hydrocarbon liquid into the overhead space and mixing the oil sand and hydrocarbon liquid in the first vessel to release air trapped in the oil sand and form the deaerated slurry;

(c) optionally adding an inert gas stream to the overhead space to displace the air released from the oil sand;

(d) collecting the deaerated slurry in the bottom space to form a slurry layer to prevent gas exchange between the first vessel and downstream extraction equipment; and (e) transporting the deaerated slurry in a sealed conduit to a second vessel;

wherein the second vessel is a sealed tumbler with a rotary screen at its end.

* * * * *